United States Patent [19]

Sakamoto et al.

[11] Patent Number: 4,883,439

[45] Date of Patent: Nov. 28, 1989

[54] APPARATUS FOR FIXTURING A CATHODE RAY TUBE

[75] Inventors: Tatsurou Sakamoto; Masayoshi Ito, both of Gifu; Yoshinori Yamano, Aichi, all of Japan

[73] Assignee: Sony Corporation, Tokyo, Japan

[21] Appl. No.: 129,142

[22] Filed: Dec. 7, 1987

[30] Foreign Application Priority Data

Dec. 8, 1986 [JP] Japan ..... 61-291911

[51] Int. Cl.[4] ..... H01J 9/24

[52] U.S. Cl. ..... 445/66; 445/45; 269/908

[58] Field of Search ..... 445/25, 45, 65, 66; 269/908; 313/482

[56] References Cited

U.S. PATENT DOCUMENTS

| | | | |
|---|---|---|---|
| 3,806,108 | 4/1974 | Adachi | 445/66 |
| 3,807,006 | 4/1974 | Segro | 445/45 |
| 4,179,778 | 12/1979 | Corson | 445/66 |
| 4,445,874 | 5/1984 | D'Augustine | 445/45 |
| 4,573,939 | 3/1986 | Wardell | 445/66 |
| 4,582,200 | 4/1986 | Sattazahn | 269/908 |
| 4,731,040 | 3/1988 | Tominaga | 445/66 |

FOREIGN PATENT DOCUMENTS

| | | | |
|---|---|---|---|
| 0108145 | 8/1980 | Japan | 445/45 |
| 0155442 | 12/1980 | Japan | 445/66 |
| 0055033 | 4/1982 | Japan | 269/908 |

*Primary Examiner*—Kurt Rowan

*Attorney, Agent, or Firm*—Hill, Van Santen, Steadman & Simpson

[57] ABSTRACT

A cathode ray tube fixturing device for position a face panel and a funnel during a frit sealing process. The device includes a cone holder for positioning a constricted portion of the funnel, and a movable abutting block which is adapted to abut against the panel and the funnel. A pivoting arm connects the cone holder with the movable abutting block, and at least one fixed abutting block is adapted to abut against the panel and the funnel and is located in opposed relationship with respect to the movable abutting block. When the funnel and the panel are mounted in the cone holder in assembled relation, their common centerline is vertical. In this assembled relation, the panel and funnel are urged against the fixed abutting block by the movable abutting block so that the seal from the panel to the funnel can be effectively produced and the fixturing device is reduced in weight.

8 Claims, 7 Drawing Sheets

APPARATUS FOR FIXTURING A CATHODE RAY TUBE

BACKGROUND OF THE INVENTION

1. Field of the Invention

The present invention is in the field of cathode ray tube fixturing devices, and particularly relates to a positioning jig for positioning a face panel and a funnel in a frit sealing process wherein the panel and the funnel are heated and sealed to each other by the intermediate layer of glass frit.

2 . Description of the Prior Art

In producing a color cathode ray tube, a frit sealing step is carried out wherein the front face panel and the funnel portion of the tube are joined together while the panel and funnel portions are held by a positioning jig. FIG. 6 of the drawings shows a conventional inclined type positioning jig. In FIG. 6, reference numeral 4 designates a frame stand which is inclined along a diagonal line. A base 5 of the fixturing device is mounted on the frame stand 4. A first abutting block 6A, a second abutting block 6B and a third abutting block 6C are mounted on the base 5 in such a manner as to be opposed to adjacent sides of a face panel 1 and a funnel portion 2. Each of the abutting blocks 6A, 6B and 6C has a panel abutting bolt 7 and a funnel abutting bolt 8 which abut against peripheral sides of the panel 1 and the funnel 2, respectively. A cone holder 9 is provided at the central portion of the frame stand 4 to position a constricted portion **2*a* of the funnel 2, that is, a so-called E-line portion (see FIG. 7) forming a reference circle in section at three points. A neck support 10 (FIG. 6) is provided to position a neck portion 3 integrally formed with the funnel 2 at two points. A carbon member 11 is provided inside the cone holder 9 and is adapted to directly contact the constricted portion 2*a* of the funnel 2. A carbon member 12 is provided on the neck support 10 and is adapted to directly contact the neck portion 3. The sealing interface between the panel 1 and the funnel 2 is indicated at reference numeral 13**.

FIG. 7 shows the various abutment positions against the panel 1, the funnel 2 and the neck portion 3. The panel 1 is held at three points $P_1$, $P_2$ and $P_3$, while the funnel 2 is held at three points $F_1$, $F_2$ and $F_3$. The E-line portion of the funnel 2 is held at three points, $E_1$, $E_2$ and $E_3$, while the neck portion 3 is held at two points, $N_1$ and $N_2$. In carrying out the frit seal, a frit is applied to an end surface of the funnel 2 and the panel is then aligned with the funnel on the frit. The assembly of panel 1 and funnel 2 is set on a positioning jig 14. At this time, the assembly is positioned in such a manner that the axis of the cathode ray tube is inclined at a predetermined angle from the vertical. Then, the assembly is brought into abutment against the respective abutting bolts 7 and 8 of the abutting block 6A, 6B and 6C by the combined weight of the panel 1 and the funnel 2, thus positioning the same. Then, the assembly of the panel 1 and the funnel 2 as positioned above is conveyed to a heat treating furnace to carry out the sealing of the panel 1 to the funnel 2.

The above described inclined type positioning jig has several distinct disadvantages.

(1) As the panel 1 and the funnel 2 are inclined, there is irregular wear of the abutting members of the abutting blocks 6A, 6B and 6C, the cone holder 9 and the neck support 10 so as to cause seal slippage as time goes on.

(2) The wear of the abutting members and the working error of the panel 1 and the funnel 2 cause a seal slippage.

(3) After the panel 1 and the funnel 2 are set on the positioning jig, the abutment condition of the abutting members is changed by vibration during conveyance. For example, some of the abutting bolts are separated from the panel 1 and the funnel 2, causing a seal slip.

(4) As the positioning jig is inclined, it is necessary to provide for mechanical and thermal strength to resist thermal deformation of the abutting members and the base 5 as well as the conveying device and the loading or unloading device. As a result, the weight of the jig may be on the order of 50 kg, requiring a great deal of labor for maintenance.

(5) With the positioning jig inclined, automatic motion of the loading and unloading device is rendered complicated, so there is an increased cost for automation.

SUMMARY OF THE INVENTION

The present invention provides a cathode ray tube fixturing device which reduces the disadvantages of the prior art, including a tendency toward seal slippage in the frit sealing step between the panel and the funnel.

The present invention also provides a cathode ray tube fixturing device which accommodates automated loading and unloading operations. This is accomplished while reducing the weight of the fixturing device itself.

In accordance with the present invention, a fixturing device may include a cone holder which is proportioned to engage a constricted portion of the funnel, and a movable abutting block which is arranged to abut the panel and the funnel. A pivotal arm is arranged to position the movable abutting block into abutting relation with the panel and the funnel. At least one fixed abutting block is provided and arranged to abut the panel and the funnel in opposed relation to the movable abutting block. The panel and the funnel when located in the cone holder are oriented along a vertical axis, and the movable abutting block is positioned upon movement to urge the panel and the funnel against the fixed abutting block.

DESCRIPTION OF THE PREFERRED EMBODIMENTS

Figure 1:
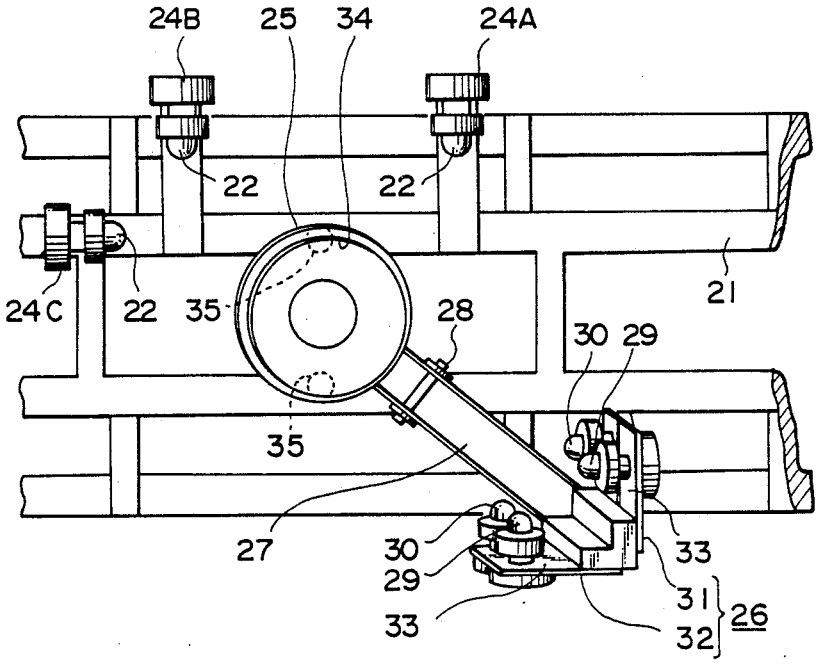
FIGS. 1 and 2 are plan and elevational views, respectively, of a device according to the present invention, FIG. 1 being partly in perspective.
Figure 2:
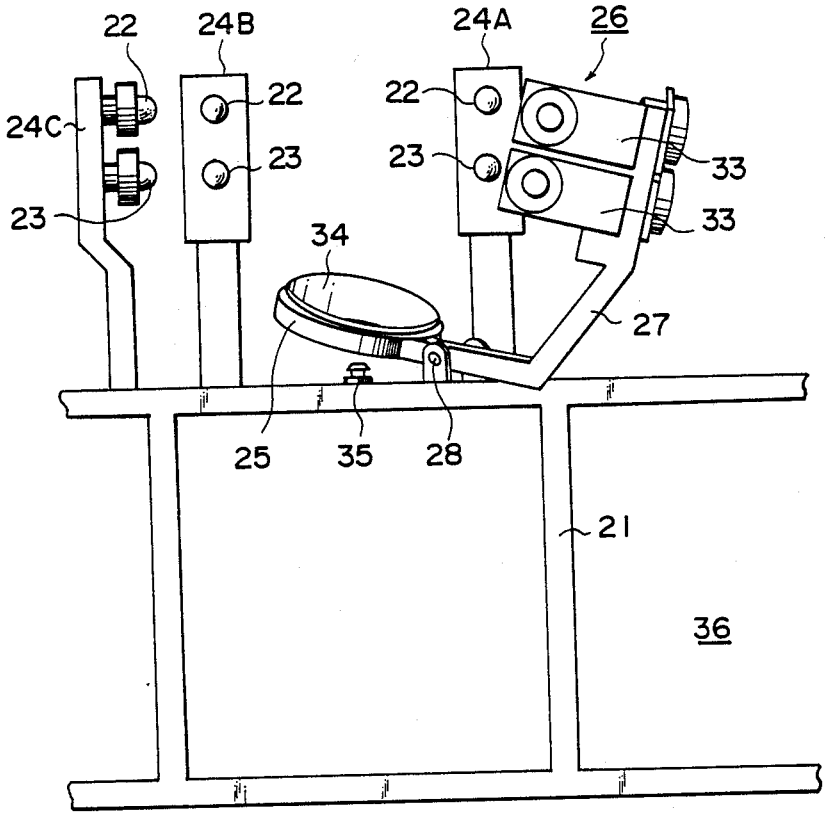

With reference to the drawings, FIGS. 1 and 2 show plan and elevational views of the positioning jig used in accordance with the present invention. In the drawings, reference numeral 21 indicates a frame stand on which first, second and third fixed abutting blocks 24A, 24B and 24C, each having a panel abutting bolt 22 together with funnel abutting bolts 23 are vertically mounted in such a manner as to be opposed to two adjacent sides of the panel 1 and the funnel 2 of the cathode ray tube. A cone holder 25 provided to vertically receive the panel 1 and the funnel 2, and a movable abutting block 26 is arranged in opposed relationship to the fixed abutting blocks 24A through 24C. The cone holder 25 and the movable abutting block 26 are connected to opposite ends of a substantially L-shaped pivoting arm 27. The pivoting arm 27 is mounted on the frame stand 21 in such a manner as to be pivoted about a fulcrum 28.

The movable abutting block 26 has two sets of abutting members 31 and 32 each including a panel abutting bolt 29 and a funnel abutting bolt 30. The abutting members 31 and 32 are arranged at right angles to each other in such a manner as to abut against adjacent sides at one corner of the panel 1 and the funnel 2.

The abutting members 31 and 32 of the movable abutting block 26 include leaf spring members 33 connected at one end to the end portion of the pivoting arm 27. The leaf spring members 33 are provided at their other ends with panel abutting bolts 29 and the funnel abutting bolts 30 so as to urge the panel 1 and the funnel 2 against the fixed abutting blocks 24A, 24B and 24C. The abutting bolts 29 and 30 project sufficiently to enable adjustment of the spring pressure of the leaf spring members 33 when the abutting bolts 29 and 30 abut against the panel 1 and the funnel 2.

The funnel abutting bolts 23 and 30 may be formed of stainless materials, while the panel abutting bolts 22 and 29 may be formed of low friction carbon materials.

Figure 5:
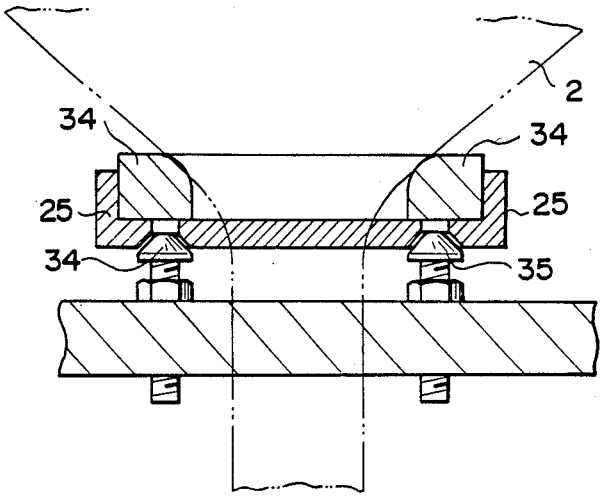
FIG. 5 is a cross-sectional view of a cone holder according to the present invention.
Figure 6:
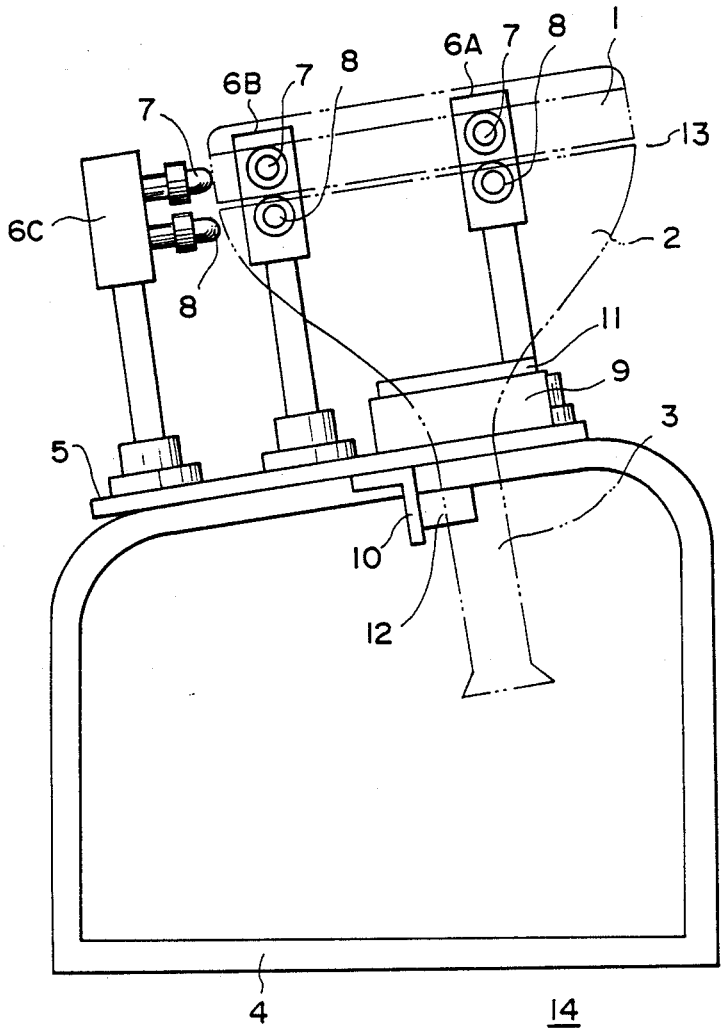
FIG. 6 (PRIOR ART)
FIG. 6 is a elevational view of a positioning jig used in the prior art.
Figure 7:
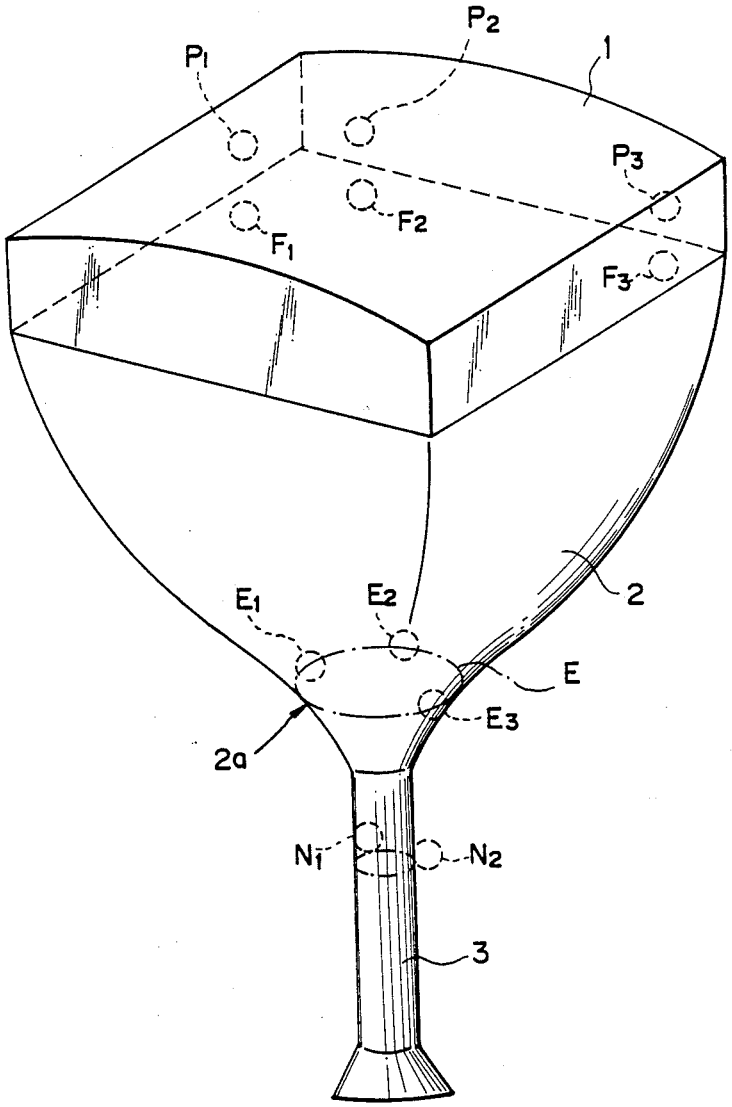
FIG. 7 (PRIOR ART)
FIG. 7 is a perspective view of the panel and the funnel of the prior art, showing the abutting positions.

The cone holder 25 has an annular shape, including an inside contact member 34 formed of a low friction carbon material contacting the funnel 2 (FIG. 5). The contact member 34 has an inside arcuate edge as seen in vertical cross-section. Accordingly, when the neck portion 3 of the funnel 2 is inserted through the cone holder 25, the constricted portion 2*a* of the funnel 2, that is, the reference sectional circular E-line portion is brought into completely circumferential contact with the inside arcuate edge of the cone holder 25.

A pair of horizontal positioning pins 35 is provided on the upper surface of the frame stand 21 in such a manner as to contact the lower surface of the cone holder 25, thereby horizontally holding the cone holder 25. The amount of the pins 35 which projects is adjustable so as to horizontally retain the cone holder 25.

The operation of the positioning device described above will now be described in detail.

When the panel 1 and the funnel 2 are not located on the positioning device, the pivotable arm 27 assembled with the cone holder 25 and the movable abutting block 26 are pivoted by their own weight about the fulcrum 28 and are stopped in the outwardly inclined position shown in FIG. 2. At this time, a portion of the pivotable arm 27 contacts the edge of the frame stand 21.

Figure 3:
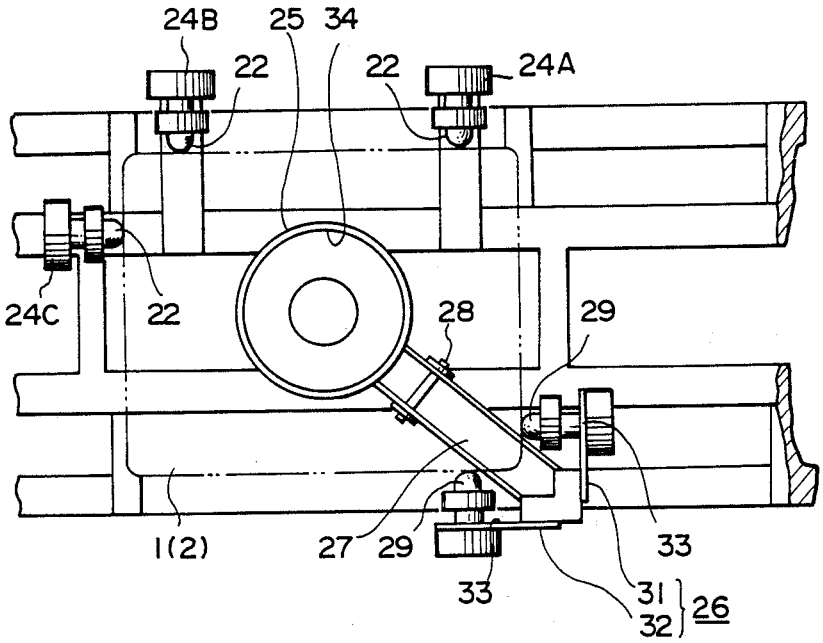
FIGS. 3 and 4 are plan and elevational views of the present invention illustrating operation of the device.
Figure 4:
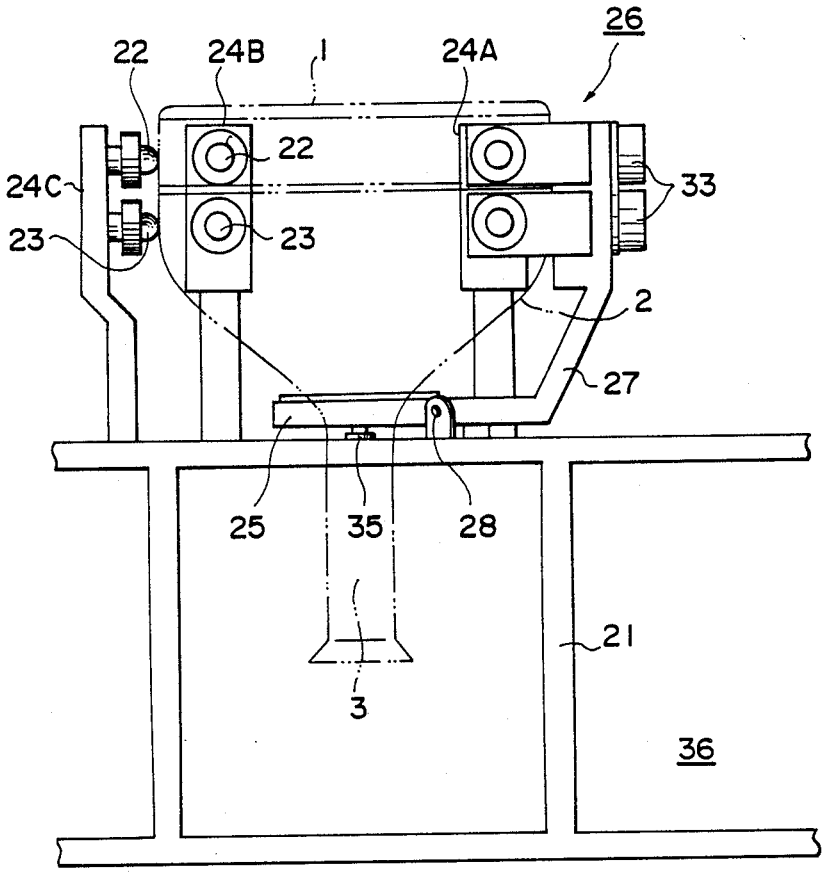

When the panel 1 and the funnel 2 are set on the positioning device so as to carry out the sealing step, a frit is applied to the seal end surface of the funnel 2 and the panel 1 is positioned on the frit. Then, the neck portion 3 is inserted through the cone holder 25 to mount the panel 1 and the funnel 2 in the cone holder 25. At this time, the pivoting arm 27 is rotated about the fulcrum 28 by the weight of the panel 1 and the funnel 2 until the cone holder 25 contacts the horizontal positioning pins 35 to be horizontally retained as shown in FIGS. 3 and 4.

Simultaneously, the abutting bolts 29 and 30 of the abutting members 31 and 32 of the movable abutting block 26 contact the adjacent two sides at the corner of the panel 1 and the funnel 2. The panel 1 and the funnel 2 are urged against the abutting bolts 22 and 23 of the fixed abutting blocks 24A, 24B and 24C by the spring force of the leaf spring members 33.

Upon abutment of the panel 1 and the funnel 2 against the abutting bolts 22 and 23, the panel 1 is brought into abutment against the abutting bolts 22 with a substantial shock. However, since the abutting bolts 22 are formed of carbon materials which serve as a wear reducing agent, the panel 1 is not injured. Additionally, since the carbon materials have a heat insulating characteristic, there is no rapid heat transfer between the panel 1 and the abutting bolts 22 when the bolts 22 contact the panel 1. Accordingly, there is no possibility of cracking the panel 1.

Since the inside peripheral edge of the contact member 34 of the cone holder 25 is formed in an arcuate shape as shown in cross-section, the constricted portion 2*a* of the funnel 2, that is, the reference E-line portion is brought into smooth contact with the inside peripheral edge of the cone holder 25. Accordingly, the panel 1 and the funnel 2 are positioned such that the axis thereof is retained in the vertical position. Then, the panel 1 and the funnel 2 are sealed to each other while in this orientation.

As described above, the panel 1 and the funnel 2 are positioned in vertically restrained condition. Therefore, there is no possibility that the abutting bolts 22, 23, 29 and 30 of the fixed abutting blocks 24A, 24B and 24C and the movable abutting block 26 and the contact portion between the cone holder 25 and the constricted portion 2*a* of the funnel 2 become irregularly worn. As a result, it is possible to reduce the slippage as time proceeds due to the irregular wear which occurs in conventional abutting members, or to reduce the seal slip due to the irregular wear and the working error of the funnel. The panel 1 and the funnel 2 are resiliently urged against the fixed abutting blocks 24 by the movable abutting block 26. Therefore, even when a vibration is applied to the positioning device on which the panel 1 and the funnel 2 are located during the loading and unloading operation and the conveying operation, there is no possibility that a portion of the abutting bolts will be moved away from the panel or the funnel 2, nor that the abutting positions are vibrated. Accordingly, the seal slip due to vibration may be reduced.

In addition, as the panel 1 and the funnel 2 can be vertically loaded and unloaded, these operations may be easily automated. Further, the weight of the device is reduced to about one third of the conventional device (from about 50 kg down to about 15 kg) thus obtaining a lightweight device and improving the maintenance thereof. Such reduction in weight contributes to energy saving in the heat treating furnace.

While the invention has been described with reference to a specific embodiment, the description is illustrative and is not to be construed as limiting the scope of the invention. Various modifications and changes may occur to those skilled in the art without departing from the spirit and scope of the invention as defined in the appended claims.

We claim as our invention:

1. A cathode ray tube fixturing device for aligning a face panel and a funnel for a frit sealing process comprising:

a cone holder proportioned to engage a constricted portion of said funnel, a movable abutting block arranged to abut both said panel and said funnel, a pivotal arm arranged to position said movable abutting block into abutting relation with said panel and said funnel, said cone holder mounted on said pivotal arm, whereby said pivotal arm pivots in response to said funnel being placed in said cone holder, and at least one fixed abutting block arranged to abut both said panel and said funnel in opposed relation to said movable abutting block, said panel and said funnel when located in said cone holder being oriented along a vertical axis, and said movable abutting block being positioned upon movement to urge said panel and said funnel against said fixed abutting block.

2. A cathode ray tube fixturing device for aligning a face panel and a funnel for a frit sealing process comprising:

a cone holder proportioned to engage a constricted portion of said funnel, a movable abutting block arranged to abut said panel and said funnel, a pivotal arm arranged to position said movable abutting block into abutting relation with said panel and said funnel, and at least one fixed abutting block arranged to abut said panel and said funnel in opposed relation to said movable abutting block, said panel and said funnel when located in said cone holder being oriented along a vertical axis, and said movable abutting block being positioned upon movement to urge said panel and said funnel against said fixed abutting block, said movable abutting block having abutting bolts and leaf spring members operating between said pivotal arm and said abutting bolts to bias said bolts against said panel and said funnel.

3. A fixturing device according to claim 2 wherein said abutting bolts are adjustable to adjust the spring pressure of said leaf spring members.

4. A fixturing device according to claim 3, wherein said abutting bolts are composed of a carbonaceous material.

5. A cathode ray tube fixturing device for aligning a face panel and a funnel for a frit sealing process comprising:

a cone holder proportioned to engage a constricted portion of said funnel, a movable abutting block arranged to abut said panel and said funnel, a pivotal arm arranged to position said movable abutting block into abutting relation with said panel and said funnel, said cone holder mounted on said pivotal arm, whereby said pivotal arm pivots in response to said funnel being placed in said cone holder, and at least one fixed abutting block arranged to abut said panel and said funnel in opposed relation to said movable abutting block, said panel and said funnel when located in said cone holder being oriented along a vertical axis, and said movable abutting block being positioned upon movement to urge said panel and said funnel against said fixed abutting block, said cone holder having a circular annular shape and including an inside contact member arranged to contact said funnel in a continuous line contract, said inside contact member being composed of a carbonaceous material.

6. A fixturing device according to claim 5, wherein said contact member has an inside arcuate surface as viewed in vertical cross-section.

7. A cathode ray tube fixturing device for aligning a face panel and a funnel for a frit sealing process comprising:

a cone holder proportioned to engage a constricted portion of said funnel, a movable abutting block arranged to abut said panel and said funnel, a pivotal arm arranged to position said movable abutting block into abutting relation with said panel and said funnel, said cone holder mounted on said pivotal arm, whereby said pivotal arm pivots in response to said funnel being placed in said cone holder, and at least one fixed abutting block arranged to abut said panel and said funnel in opposed relation to said movable abutting block, said panel and said funnel when located in said cone holder being oriented along a vertical axis, and said movable abutting block being positioned upon movement to urge said panel and said funnel against said fixed abutting block, said fixturing device further including a pair of horizontal positioning pins arranged to hold said cone holder in a horizontal orientation.

8. A fixturing device according to claim 7, wherein said pins are adjustable to provide a horizontal positioning of said cone holder.

* * * * *